United States Patent [19]

Ziemek et al.

[11] Patent Number: 4,663,954

[45] Date of Patent: May 12, 1987

[54] METHOD AND APPARATUS FOR THE CORRUGATING OF METAL TUBES

[75] Inventors: Gerhard Ziemek, Langenhagen; Herbert Kubiak, Hanover; Klaus Tripke, Wedemark, all of Fed. Rep. of Germany

[73] Assignee: Kabelmetal Electro Gesellschaft mit beschränkter Haftung, Hanover, Fed. Rep. of Germany

[21] Appl. No.: 768,891

[22] Filed: Aug. 23, 1985

[30] Foreign Application Priority Data

Aug. 24, 1984 [DE] Fed. Rep. of Germany ..... 3431120

[51] Int. Cl.[4] ..... B21D 15/06

[52] U.S. Cl. ..... 72/77

[58] Field of Search ..... 72/68, 77, 78, 79

[56] References Cited

U.S. PATENT DOCUMENTS 3,656,331 4/1972 Kuypers et al. .

3,672,196 6/1972 Levacher et al. ..... 72/77

3,973,424 8/1976 Albes et al. .

4,047,418 9/1977 Fangmeier et al. ..... 72/79

FOREIGN PATENT DOCUMENTS 1086314 8/1960 Fed. Rep. of Germany .

1164355 9/1964 Fed. Rep. of Germany .

*Primary Examiner*—Lowell A. Larson

*Attorney, Agent, or Firm*—Martin A. Farber

[57] ABSTRACT

In a method for the corrugating of metal tubes in which a smooth tube, preferably a longitudinally seam welded smooth tube is passed continuously through a bushing and acted on immediately behind the bushing by a corrugating tool, in which tool a corrugator disk having a larger inside opening than the diameter of the smooth tube is mounted for free rotation eccentrically in a corrugator head which can be driven in rotation, and the corrugated tube is deflected from the direction of manufacture in the direction towards the place of action of the corrugator disk in order to obtain a deeper corrugation.

20 Claims, 3 Drawing Figures

METHOD AND APPARATUS FOR THE CORRUGATING OF METAL TUBES

FIELD AND BACKGROUND OF THE INVENTION

The invention relates to a method of corrugating metal tubes in which a smooth tube, preferably a longitudinal seam-welded smooth tube, is passed continuously through a bushing and the smooth tube is acted on directly behind the bushing by a corrugating tool in which a corrugator disk having a larger inside diameter than the diameter of the smooth tube is mounted for free rotation eccentrically in a corrugator head which can be driven in rotation.

From Federal Republic of Germany AS No. 1086314 a method is known for the production of corrugated tubes in which thin-wall metal tubes, particularly those which are made from a long strip of sheet metal by continuous deformation to form an open-seam tube, the seam surfaces being then welded together, are deformed into a corrugated tube by an annular corrugator disk which pushes into the circumference of the smooth tube. The corrugating is effected continuously along a helical line with a given depth of corrugation and given pitch in the manner that, within the corrugator head which supports it, the corrugator disk is arranged eccentric to the axis of the tube and inclined at a given angle to it. By the above-described arrangement it is possible to manufacture corrugated tubes in economic fashion. To be sure, only corrugated tubes which have a relatively shallow corrugation can be produced with this device. Such corrugated tubes can be wound on ordinary cable drums and are used, for instance, as sheathing for electric cables, or else as conduits.

If a corrugator disk having a helically extending deforming rib is used in the above-mentioned method, then so-called parallel-corrugated tubes can be produced by this method (Federal Republic of Germany OS No. 1916357).

In order to obtain a deeper corrugation, the corrugation in the aforementioned method has been carried out under axial load in the manner for instance that the metal tube is retarded, as seen in the direction of passage, after the corrugating. Due to the fact that in this method the corrugating tool, i.e. the corrugating disk, is free of forces acting axially on it, a deep corrugation is obtained. However, it has been found that this method leads to difficulties in actual practice, since the application of constant retarding forces—constant retarding forces are indispensable in order to obtain a uniform corrugation—is not possible (Federal Republic of Germany Patent No. 2400842).

The flexible corrugated hoses (metal hoses) obtainable on the market have up to now been produced in discontinuous fashion in that, starting from a length of smooth tube, the corrugation is applied in several passes, the tube being under axial pressure and being pushed together during the corrugation. Longer lengths cannot be produced by this method.

SUMMARY OF THE INVENTION

Accordingly, it is an object of the present invention further to develop the aforementioned method in such a manner that metal hoses, i.e. corrugated tubes having a deep narrow corrugation, can be produced continuously, i.e. in long lengths.

According to the invention, the corrugated tube is deflected from its direction of production into the direction towards the place of action (pressing contact) of the corrugator disk on the tube.

Studies of this kind of method have shown that the corrugator disk, during the corrugation, pushes a "bow wave" in the tube wall ahead of it. By the deflecting of the corrugated tube, namely the bending of the corrugated tube opposite the direction of the place of action of the corrugator disk, the "bow wave" is supported. The deflection, namely bending process is so designed that the tube which has already been corrugated is so bent at every moment of the corrugating process that the corrugator disk and the "bow wave" are present in the region of compression of a bent tube. By the rotating bending process the corrugator tube is offered additional material, so that a deeper corrugation is readily possible.

According to one particularly suitable development of the method of the invention, a force acts on the corrugated tube on the side located opposite the instantaneous place of action of the corrugator disk. This force assures a bending, namely deflection of the tube between the bushing which supports the smooth tube and the place of action of the force. It is essential, in this connection, that the force act on the corrugated tube at a distance a away from the corrugator disk of at least 0.5 D and preferably at least 0.8 D, D being the outside diameter of the smooth tube. The eccentricity e with which the corrugated tube is deflected out of the direction of production satisfies the relationship that e/a be less than 1 and preferably less than 0.2. The maximum deviation of the point of attack (application) of the deflecting force in the circumferential direction is $\pm 30°$, depending on the material of which the tube to be corrugated consists, with a lead or lag on the side of the tube opposite the place of action of the corrugated disk. Thus, for instance, it has been found advantageous for the point of attack of the deflection force, as seen in the direction of rotation of the corrugator disk, to be less than 180° in the case of "soft materials" such as copper, while in the case of "hard materials," such as steel, alloy steel and the like, it is greater than 180°.

The invention furthermore concerns an apparatus for the carrying out of the method, this apparatus consisting of a stationarily installed bushing which supports the smooth tube and of a rotating corrugator tool which acts on the smooth tube behind the bushing as seen in the direction of passage of the tube, said tool consisting of a corrugator head which can be driven in rotation and in which a corrugator disk is arranged eccentrically for free rotation. This apparatus is characterized by the fact that behind the corrugator head (6) there is provided a tool (8) which acts on the corrugated tube (7), while rotating with the same speed as the corrugator head, and deflects said tube. The tool is advisedly fastened to the corrugator head. In order to assure good guidance of the tube during the deflection, the tool (8, 18) is of ring-shaped development. The ring (18) is preferably mounted for free rotation in a support (16) fastened to the corrugator head (6). In this way, frictional forces in the circumferential direction are reduced to a minimum. The ring-shaped tool is developed in the manner of a nipple, i.e. the inlet and outlet openings widen in funnel shape. In order that the tool can be adapted optimally to the diameter of the tube and the material of the tube, the tool (8) is fastened on the corrugator head (6) in such a manner that it can move both in circumferential direction and in radial direction. The distance between the tool and the corrugator disk can be changed by the insertion of rings. The bushing (11*a*) can be displaced in axial direction before the start of the corrugating process. Thus, a larger distance from the corrugator disk is advantageously selected for soft materials than for hard materials.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
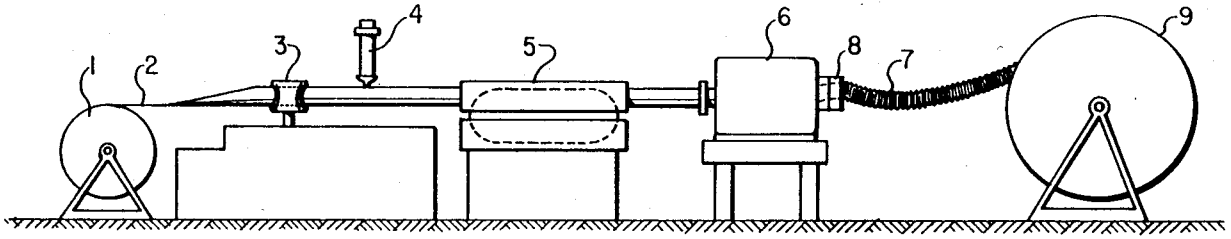
FIG. 1 is a schematic illustration of the manufacture of a corrugated tube.

The metal strip 2 which is to be shaped is withdrawn from a coil 1. The strip 2 is cut to size between two pairs of circular knives (not shown) and shaped to form an open-seam tube in the forming step by means of a pair of rollers 3. By means of a welding device 4, preferably an electric arc-welding device, the strip edges of the open-seam tube are welded together and the tube, which is now closed but still smooth, is grasped by the draw-off device 5 and fed to a corrugating tool 6. As draw-off device there is preferably used a so-called collet-chuck draw-off such as known from Federal Republic of Germany Patent No. 1164355. A corrugated tube 7 emerging from the corrugating tool 6 is deflected out of the direction of manufacture by a rotating tool 8, as will be described further below. The corrugated tube 7 can then be wound up on an ordinary cable drum 9.

Figure 2:
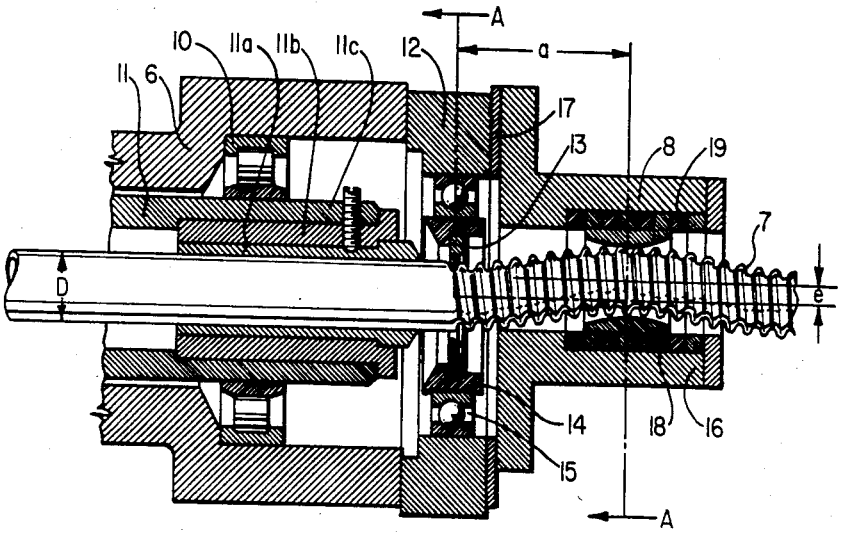
FIG. 2 is a broken-away axial section of the corrugating device and corrugating tool.
Figure 3:
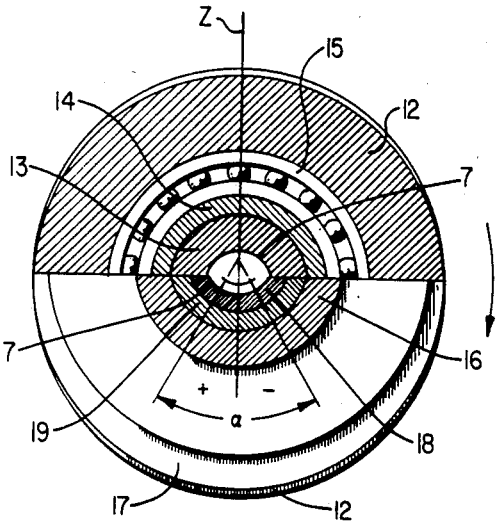
FIG. 3 is a section along the line A—A of FIG. 2.

The corrugating device and the deflection tool are shown in larger size in FIGS. 2 and 3. The corrugator head 6 rests via a ball bearing or roller bearing 10 on the stationary guide bushing 11. The guide bushing 11 consists of a sliding bushing 11*a*, an adjustment bushing 11*b* and the outer bushing 11*c* which is rigidly attached to the machine housing.

The corrugator head 6 is driven in rotation, in a manner not shown in the drawing, and bears at its end surface the housing 12 within which the corrugator disk 13 is fastened. The corrugator disk 13 is fastened in a ring bushing 14 which is mounted for rotation in the housing 12 via a ball bearing 15. Due to the fact that the corrugator disk 13 is rotatable and is mounted eccentrically to the axis of the tube, it pushes, upon the rotation of the corrugator head 6, into the surface of the smooth tube, thereby producing a corrugation which is helical in the event of a ring-like corrugator disk 13. If a corrugator disk having a helically extending deforming rib is used, an annular corrugation is obtained. Herein the term "circumferential corrugations" include for example annular as well as helical corrugations.

At the front end of the housing 12 there is arranged a tool 8 which deflects the corrugated tube 7 out of the direction of production. The tool 8 consists of a flange-like part 16 which, with the interposition of a disk 17, is fastened for displacement in radial and circumferential directions on the housing 12. Within the part 16 there is a bushing 18 whose inner bore widens in funnel-like fashion towards its ends. The distance between the bushing 18 and the corrugator disk 13 can be varied by spacer rings 19. The tool 8 is so fastened to the housing 12 that it rotates eccentrically to the center line of the corrugator head 6 and thus to the center line of the smooth tube and deflects the corrugator tube 7 continuously out of the center line. The eccentricity of the corrugator disk 13 is exactly opposite the eccentricity of the tool 8, so that more material for the forming of the corrugation is available to the corrugator disk 13 as a result of bending of the corrugated tube 7 thus making a deeper corrugation possible. The distance a between the corrugator disk 13 and the bushing 8, i.e. the distance between the center lines of the corrugator disk 13 and the bushing 18, is dependent on the outside diameter D of the smooth tube and should be at least 0.5 D. A spacing of 1 to 1.5 D has proven particularly advantageous. The angle by which the corrugator tube 7 is deflected out of the center line is also essential for a clean, deep corrugation. Since the angle itself is very difficult to measure, the ratio of the eccentricity e of the tool 8 to the spacing a is used as aid in the measurement thereof, which ratio should be less than 1 and preferably on the order of magnitude of 0.15. The eccentricity e is the distance from the center line of the tool 8 to the center line of the corrugator head 6.

The bushing 18 is preferably mounted for free rotation in the part 16 by means of a ball bearing.

FIG. 3 is a section along the line A—A. The points of attack on the tube 7 both by the corrugator disk 13 and by the bushing 18 lie on the axis Z and are therefore 180° apart from each other. The arrangement shown in the drawing would be the ideal arrangement for a "normally hard" material. The lead or lag of the bending is dependent on the following factors:

(a) the physical properties of the material of the tube
(b) the geometrical dimensions of the tube
(c) the distance (a) between the point of action of the force of the corrugator disk 13 and the point of action of the bushing 18
(d) the eccentricity e of the tool 8 with respect to the central axis of the corrugator head 6.

For a "soft material" such as copper, a lag of 10°, for instance, has proven advantageous, while for a relatively "hard material" such as alloy steel a lead of 15° has proven advantageous. Lead and lag are indicated by plus and minus signs in FIG. 3.

The corrugation of the tube 7 is shown merely diagrammatically in FIG. 2. The corrugation is actually substantially deeper. Thus, for instance, a smooth copper tube having an outside diameter of 40.4 mm and a wall thickness of 0.5 mm was formed into a corrugated tube whose outside diameter was also 40.4 mm while its inside diameter was 25.7 mm. The pitch of the corrugation was 3.1 mm.

We claim:

1. A method of corrugating metal tubes comprising the steps of:

passing a smooth tube continuously through a bushing defining a center line of the tube;

acting on the tube at a place of contact therewith directly downstream of the bushing by a corrugating tool with a corrugator disk of the tool pressing on the tube at the place of contact and having a larger inside diameter than the diameter of the smooth tube and being mounted for free rotation eccentrically in a corrugator head so as to produce corrugations on the tube, the corrugations on the tube moving with the tube downstream of the disk as a result of said passing step and defining a corrugated tube portion; and deflecting the corrugated tube portion from said center line towards the place of contact of said corrugator disk with a pressing tool, the pressing tool being at a greater distance downstream from the corrugator disk than the corrugator disk is downstream from the bushing, whereby the tube between the bushing and the corrugator disk is not subject to bending force.

2. The method according to claim 1, wherein a deflecting force of said deflecting step is applied on the corrugated tube on a side of the tube located substantially opposite a simultaneously-occurring instantaneous place of contact of the corrugator disk upon the tube.

3. The method according to claim 2, wherein said distance a is at least 0.8 D.

4. The method according to claim 2, wherein the deflecting force is applied to the corrugated tube at a distance a away from the corrugator disk measured in the direction of said center line of at least 0.5 D wherein D is the outside diameter of the smooth tube.

5. The method according to claim 4, wherein the eccentricity e with which the corrugated tube is deflected away from said center line satisfies the relationship that e/a be less than 1.

6. The method according to claim 4, wherein the eccentricity e with which the corrugated tube is deflected away from said center line satisfies the relationship that e/a be less than 0.2.

7. The method according to claim 2, wherein a region on said opposite side of said tube of application of said deflecting force in a circumferential direction is within ±30° directly opposite said place of contact.

8. The method according to claim 7, wherein the point of application of the deflecting force, as seen in a direction of rotation of the corrugator disk is less than 180° from said place of contact when said tube is made of relatively soft materials and when said tube is made of relatively hard materials the point of application is greater than 180° from said place of contact.

9. In an apparatus for corrugating a smooth tube passing through the apparatus, the apparatus comprising a fixed bushing which supports the smooth tube defining a center line of the tube and a rotating corrugator tool which acts on the smooth tube downstream of the bushing, said tool including a rotatable corrugator head in which a corrugator disk is held eccentrically freely rotatably pressing on the tube at a place of contact therewith so as to produce corrugations on the tube, the corrugations on the tube moving with the tube downstream of the disk as a result of the passing of the tube through the apparatus and defining a corrugated tube portion, the improvement comprising a pressing tool downstream of the corrugator head, said pressing tool acts on the corrugated tube portion while rotating with the same speed as the corrugator head, the pressing tool is a greater distance downstream from the corrugator disk than the corrugator disk is downstream from the fixed bushing, said pressing tool constitutes means for deflecting said corrugated tube portion away from said center line towards said place of contact of said corrugator disk on said tube.

10. The apparatus according to claim 7, wherein said pressing tool is fastened to the corrugator head.

11. The apparatus according to claim 7, wherein said pressing tool has the form of a ring.

12. The apparatus according to claim 11 wherein said pressing tool includes, a ring support, said ring is mounted for free rotation in said support, said support being fastened to the corrugator head.

13. The apparatus according to claim 12, wherein said pressing tool is fastened to the corrugator head such that said pressing tool is movable both in circumferential direction and in radial direction.

14. The apparatus according to claim 12, wherein said pressing tool includes positioning rings, said ring support has an enclosure for support of said positioning rings for adjustment of distance between the pressing tool and the corrugator disk, which distance is adjustable by the insertion of the positioning rings.

15. The apparatus according to claim 11, wherein said pressing tool is is formed as a bushing having an inner bore in which said corrugated tube portion extends, said inner bore having inlet and outlet openings widening in funnel shape towards ends thereof.

16. The apparatus according to claim 7, further comprising means for displacing said bushing in axial direction away from said corrugator tool before the start of a corrugating process.

17. An apparatus for corrugating a tube passing through the apparatus, comprising fixed guide means for guiding the tube linearly, corrugator means for pressing circumferential corrugations on said tube at a place of pressing to form a corrugated tube portion, the latter passing downstream of said corrugator means, bending means downstream of said corrugator means for bending said corrugated tube portion in a direction substantially toward said place of pressing, and wherein the bending means is disposed at a greater distance downstream from the corrugator means than the corrugator means is downstream from the fixed guide means.

18. The apparatus according to claim 17, wherein said corrugator means presses said circumferential corrugations continuously around the circumference of said tube at said place of pressing, the latter continuously moving around the circumference of said tube, said bending means continuously bends said corrugated tube portion in a direction substantially toward said place of pressing, said direction continuously moving around the circumference of said tube.

19. The apparatus according to claim 18, wherein said corrugator means comprises, a corrugator ring having an inner opening larger than the cross-section of said tube, the latter passing through said opening, and means for rolling said annular ring around the circumference of said tube for pressing said corrugations on said tube.

20. The apparatus according to claim 19, wherein said bending means comprises, a pressing ring having an inner opening through which said corrugated tube portion passes for bending said corrugated tube portion by pressing thereon, and means for rotating said pressing ring eccentrically to a center line of said tube, defined where said tube passes into said inner opening of said corrugator ring.

* * * * *